US005839396A

United States Patent [19]

Franke et al.

[11] Patent Number: 5,839,396

[45] Date of Patent: Nov. 24, 1998

[54] METHOD AND APPARATUS FOR STARTING UP A CONTINUOUS-FLOW STEAM GENERATOR

[75] Inventors: Joachim Franke, Altdorf; Eberhard Wittchow, Erlangen, both of Germany

[73] Assignee: Siemens Aktiengesellschaft, Munich, Germany

[21] Appl. No.: 909,217

[22] Filed: Aug. 11, 1997

Related U.S. Application Data

[63] Continuation of PCT/DE96/00115 Jan. 29, 1996, published as WO96/24803 Aug. 15, 1996.

[30] Foreign Application Priority Data

Feb. 9, 1995 [DE] Germany ..... 195 04 308. 1

[51] Int. Cl.[6] ..... F22D 7/00

[52] U.S. Cl. ..... 122/406.5; 122/479.1

[58] Field of Search ..... 122/406.5, 479

[56] References Cited

U.S. PATENT DOCUMENTS

| | | | |
|---|---|---|---|
| 3,576,180 | 4/1971 | Michel | 122/406.5 |
| 3,648,667 | 3/1972 | Dolezal | 122/406 |
| 4,262,636 | 4/1981 | Augsburger | 122/406.5 |
| 4,430,962 | 2/1984 | Miszak | 122/406.5 |
| 5,056,468 | 10/1991 | Wittchow et al. | 122/406.5 |
| 5,396,865 | 3/1995 | Freeh | 122/406.5 |

FOREIGN PATENT DOCUMENTS

| | | |
|---|---|---|
| 0054601A1 | 6/1982 | European Pat. Off. . |
| 0054601B1 | 9/1984 | European Pat. Off. . |
| 0439765A1 | 8/1991 | European Pat. Off. . |

*Primary Examiner*—Teresa J. Walberg
*Assistant Examiner*—Gregory A. Wilson
*Attorney, Agent, or Firm*—Herbert L. Lerner; Laurence A. Greenberg

[57] ABSTRACT

A continuous-flow steam generator has a combustion chamber with a number of burners for fossil fuel. A gas-tight containing wall is formed from approximately vertical evaporator tubes, through which a medium passes from the bottom upwards. A start-up process is maximized with regard to the reduction in start-up losses. The evaporator throughput is set in proportion to the firing heat capacity in the combustion chamber. A control device has a control module for setting the quantity of medium supplied to the evaporator per unit time, in dependence on the fuel quantity supplied to the burner or each burner per unit time.

7 Claims, 2 Drawing Sheets

METHOD AND APPARATUS FOR STARTING UP A CONTINUOUS-FLOW STEAM GENERATOR

CROSS-REFERENCE TO RELATED APPLICATION

This application is a continuation of copending international application PCT/DE96/00115, filed Jan. 29, 1996, published as WO96/24803 Aug. 15, 1996.

BACKGROUND OF THE INVENTION

1. Field of the Invention

The invention relates to steam generator operation. More specifically, it pertains to a method for starting up a continuous-flow or once-through steam generator with a combustion chamber that includes a plurality of burners for a fossil fuel. Further, the combustion chamber has a gas-tight containing wall which is formed from at least approximately vertical evaporator tubes through which the medium passes from the bottom upwards. The invention also pertains to an apparatus for carrying out the novel method.

A circulated water/steam mixture in a natural-circulation steam generator is evaporated only partially. In a continuous-flow steam generator, on the other hand, the heating of vertical evaporator tubes forming the gas-tight containing walls of a combustion chamber leads to a complete evaporation of the flow medium in the evaporator tubes in one passage.

Conventionally, during the start-up operation, a circulating flow is superimposed on the continuous flow of the evaporator of the continuous-flow steam generator, and often also on a flue-gas-heated preheater or economizer in the continuous-flow steam generator. This results in reliable cooling of the tubes due to the correspondingly high velocities in the tubes. At the same time, the minimum flow consisting of the continuous-flow and of the superposed circulating flow amounts to between 25% and 50% of the full-load flow in the case of vertically arranged tubes in the containing walls of the combustion chamber. This means that, during the start-up operation, the steam generator load first has to be increased to at least 25% to 50%, before the continuous-flow mode beneficial in terms of efficiency and with its high steam-outlet temperatures is achieved.

It has become known heretofore from U.S. Pat. No. 4,430,962 (European patent specification 0 054 601 B1), therefore, to preferably keep the quantity of flow medium to be conveyed by a feed pump constant for the start-up and in a load range which is below a specific limit load of 50% of the full load. In this case, the feed flow of the feed pump is equal to the evaporator throughput. In this mode of operation, the start-up times commencing with the ignition of a first burner of the continuous-flow steam generator and ending when the continuous-flow mode with its high steam temperatures is attained are very long. This has also relatively high start-up losses, since their magnitude is influenced appreciably by the start-up times.

In the steam generator known from U.S. Pat. No. 5,056,468 (European patent application 0 439 765) as well, there is provided an essentially constant feedwater flow during start-up. Towards the end of the starting operation, however, a variation in the feedwater flow may also be provided in that prior art steam generator.

A reduction in the start-up losses therefore assumes increased importance with regard to the efforts to increase the mean efficiency of a power station—the efficiency also encompassing the start-up operation—particularly by bringing about high and very high steam states. Furthermore, in a power station of this type, it must be appreciated that the circulation loop, which is to be installed for the start-up operation and which conventionally comprises at least one circulating pump with corresponding accessories or a run-off heat exchanger, involves a high technical outlay and therefore necessitates high investment costs. These investment costs increase sharply where high and very high steam pressures are required.

SUMMARY OF THE INVENTION

It is accordingly an object of the invention to provide a method and device for starting up a continuous steam generator, which overcomes the above-mentioned disadvantages of the heretofore-known devices and methods of this general type and which allows the operation of a continuous-flow steam generator with low start-up losses. It is a further object to provide an apparatus suitable for carrying out the method at a minimum in technical outlay.

With the foregoing and other objects in view there is provided, in accordance with the invention, a method for starting up a continuous-flow steam generator of the type having a combustion chamber and a number of burners for combusting fossil fuel in the combustion chamber, the combustion chamber having a gas-tight containing wall formed of substantially vertical evaporator tubes. The method comprises the steps of:

- conducting a medium through the evaporator tubes from the bottom upwards;
- supplying fuel to the burners and adjusting a firing heat capacity in the combustion chamber; and
- adjusting an evaporator throughput in dependence on a quantity of fuel supplied to one burner or each of the burners per unit time.

In other words, the objects of the invention are satisfied with the method in that the evaporator throughput is set in dependence on the fuel quantity supplied to one or each of the firing burners per unit time, and the evaporator throughput is set in proportion to the firing heat capacity in the combustion chamber.

Due to the fact that the percentage firing heat capacity related to full load (100% load) is selected as a setpoint value for the percentage evaporator throughput, the evaporator throughput (i.e., the quantity of medium supplied to the evaporator per unit time and flowing through the latter) is set within a narrow tolerance band.

The invention is premised on the recognition that a continuous-flow steam generator can also be started up with a rapidly rising firing capacity, since its relatively thin-walled components allow high rates of change in temperature. On account of the low storage mass of the evaporator, rapid steam formation is established, with the result that superheater heating surfaces provided for the superheating of generated steam are cooled thoroughly.

The conventional start-up methods for continuous-flow steam generators are based on the assumption that the evaporator tubes of the highly heated combustion chamber are cooled thoroughly only when the medium flow in the tubes is turbulent. This presupposes a correspondingly high mass flow density in the tubes even during the start-up operation.

The instantly disclosed invention is further premised on the consideration that, even at very low mass flow densities and simultaneous high heat flow densities, there exists very good heat transfer from a tube wall to the flow medium when so-called annular flow forms. Recent investigations into the internal heat transfer in vertical tubes have surprisingly, even at very low mass flow densities, confirmed the formation of an annular flow of this type, in which a large water fraction in the flow medium formed by a water/steam mixture is always transported to the tube wall.

This leads to the good heat transfer mentioned, even in the case of a minimum flow which is below approximately 25% of the full-load flow. Full-load flow is the rated evaporator throughput under 100% load.

In the method for operating a continuous-flow steam generator during the start-up, the thermal phenomenon described is utilized especially advantageously, particularly when, starting from a minimum throughput of the evaporator of less than 15%, preferably less than 10%, for example 5% of the full-load throughput, the evaporator throughput deviates only in a narrow bandwidth from the percentage firing heat capacity related to full load.

At the commencement of the start-up operation, the evaporator throughput is expediently limited to from 5% to 10% of the full-load throughput. This guarantees, from the outset, a uniform upward flow in all the evaporator tubes. After the ignition of the first burner, the evaporator throughput is set in such a way that the percentage evaporator throughput related to the full-load throughput, within a specific bandwidth, corresponds to the percentage firing heat capacity related to full load. In this case, the bandwidth extends preferably between 3% and 8% above and between 2% and 3% below the percentage firing heat capacity rising over time. This condition of an asymmetric bandwidth applies particularly to a firing heat capacity in which stable combustion is ensured.

With the above and other objects in view there is also provided, in accordance with the invention, an apparatus for starting up a continuous-flow steam generator having a combustion chamber with a number of burners for fossil fuel, the combustion chamber having a gas-tight containing wall formed of substantially vertical evaporator tubes, a feedwater conduit leading into the evaporator tubes and a fuel line supplying the fossil fuel to the burners. The novel apparatus for starting up the continuous-flow steam generator comprises:

- a control module establishing a regulating variable determining an evaporator throughput, the evaporator throughput being proportional to a firing heat capacity established from the quantity of fuel fed to one of the burners or to each burner per unit time;
- a regulating element connected to the control module, the regulating element being connected into the feedwater conduit leading to the evaporator; and
- a flow sensor connected to the control module, the sensor being disposed in the fuel line leading to the one burner or to each of the burners.

In accordance with a concomitant feature of the invention, a further flow sensor is disposed in the feedwater conduit. The further flow sensor is also connected to the control module.

The control module thus satisfies the objects of the invention in that the control module sets the quantity of medium supplied to the evaporator per unit time, in dependence on the fuel quantity supplied to the burner or each burner per unit time. The evaporator throughput rate determined by a regulating variable established by the control module is thereby proportional to the firing heat capacity established from the quantity of fuel. The control module is connected to the regulating element connected into the feedwater conduit leading to the evaporator and to a second flow-measuring sensor, connected into a fuel line leading to the burner or to each burner.

Although U.S. Pat. No. 4,825,654 (EP 0 308 596 A1) discloses a means for controlling the quantity of feedwater of a naturally circulating steam generator plant, in which a measured value characterizing a quantity of fuel filtered to the burner can be fed to a control module, the document does not disclose how a set value established by the control module for the quantity of feedwater could depend on the firing heat capacity.

The evaporator throughput is expediently used as the above-noted control variable. In other words, the quantity of feedwater supplied to the evaporator on the medium side per unit time is a proper control variable. The control module obtains information regarding the evaporator throughput from the flow sensor connected into the feed-water conduit.

The advantages achieved by means of the invention are, in particular, that, as a result of an evaporator throughput rising uniformly with the firing heat capacity during a start-up operation of the continuous-flow steam generator, the start-up losses fall. This is due to the fact that, even at a low load, a continuous-flow mode beneficial in terms of efficiency is achieved. At the same time, the circulating pumps or run-off heat exchangers can advantageously be dispensed with, so that the investment costs are reduced and the station availability is increased.

Since there is also no need for a return of separated water from a water/steam separating device downstream of the evaporator into a point between the feed pump and evaporator, in a loop without a circulating pump, the setting of the start-up operation is simplified substantially. Fluctuations in enthalpy during the inlet of the water stream into the evaporator and consequently also fluctuations in the water stream emerging from the evaporator are thereby avoided.

Other features which are considered as characteristic for the invention are set forth in the appended claims.

Although the invention is illustrated and described herein as embodied in a method and apparatus for starting up a continuous-flow steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
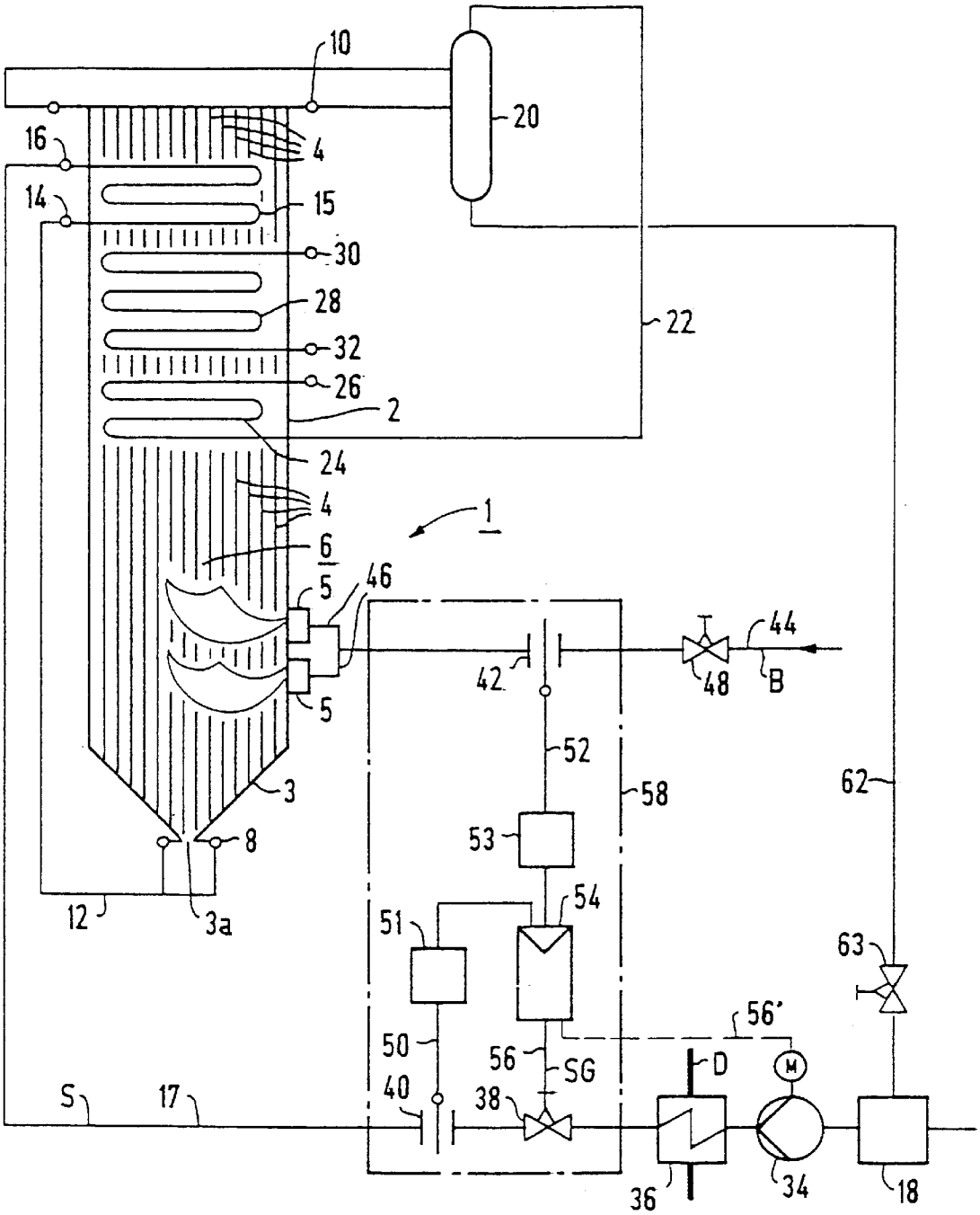
FIG. 1 is a schematic view of a continuous-flow steam generator with a vertical gas flue and with a start-up control device.

Referring now to the figures of the drawing in detail and first, particularly, to FIG. 1 thereof, there is seen a vertical gas flue of a steam generator 1. The gas flue has a rectangular cross-section and is formed by a containing wall 2 which merges at the lower end of the gas flue into a funnel-shaped bottom 3. Evaporator tubes 4 of the containing wall 2 are connected, for example by welding, to one another in a gas-tight manner on their longitudinal sides. The bottom 3 comprises as diagrammatically indicated discharge orifice 3*a* for ash.

The lower region of the containing wall 2 forms a combustion chamber 6 of the continuous-flow steam generator 1. The combustion chamber 6 is provided with a number of burners 5.

A medium such a feedwater or a water/steam mixture flows through the evaporator tubes 4 of the containing wall 2 from the bottom upwards in parallel, or in succession in the case of evaporator-tube groups. The evaporator tubes 4 are connected at their inlet ends to an inlet header or inlet collector 8 and at their outlet ends to an outlet header or outlet collector 10. The inlet header 8 and the outlet header 10 are located outside the gas flue and, for example, are formed in each case by an annular tube.

The inlet header 8 is connected to the outlet of a high-pressure preheater or economizer 15 via a conduit 12 and a collector 14. The heating surface of the economizer 15 is arranged in a space of the containing wall 2 located above the combustion chamber 6. The economizer 15 is connected on the inlet side via a collector 16 to a feed-water tank 18 which is connected via a condenser to a steam turbine and is thus connected into the water/steam loop of the latter.

The outlet collector 10 is connected via a water/steam separating vessel 20 and a conduit 22 to a high-pressure superheater 24 which is arranged within the containing wall 2 between the economizer 15 and the combustion chamber 5. During operation, the high-pressure superheater 24 is connected on the outlet side to a high-pressure part of the steam turbine via a collector 26. An intermediate superheater 28 is provided within the containing wall 2 between the high-pressure superheater 24 and the economizer 15. The intermediate superheater 28 is connected via collectors 30, 32 between the high-pressure part and a medium-pressure part of the steam turbine.

A motor-operated feed-water pump 34 and a heat exchanger 36 for feedwater preheating, as well as a valve 38 and a flow sensor 40 (throughflow-measuring sensor), are connected into the feed-water conduit 17 in succession in the direction of flow of the feedwater S out of the feed-water tank 18. The heat exchanger 36 is heated by means of steam D. The flow sensor 40 serves for determining the quantity of feedwater S carried via the feed-water conduit 17 per unit of time. The quantity of feedwater S carried via the conduit 17 per unit of time corresponds to the feed-water quantity, supplied to the evaporator consisting of the evaporator tubes 4, and therefore to the evaporator throughput.

A further flow sensor 42 is connected into a fuel line 44 which opens via partial lines 46 into the burners 5. A valve 48 for setting the quantity of fuel B supplied to each burner 5 per unit time is connected into the fuel line 44.

The flow sensors 40 and 42 are connected to a control module 54 via signal lines 50 and 52, into which transducers 51 and 53 are inserted. The control module 54 is connected to the valve 38 via a line 56. The control module 54 can alternatively also be connected to the motor-operated feed-water pump 34 via a line 56 shown broken. The control module 54 and the flow sensors 40, 42 as well as the valve 38 for setting the quantity of feedwater S are integral parts of a control device 58 for starting up the continuous-flow steam generator 1. Instead of the valve 38, the feed-water pump 34 itself, by variation of its rotational speed, can also be used to set the quantity of feedwater S carried via the feed-water conduit 17.

Figure 2:
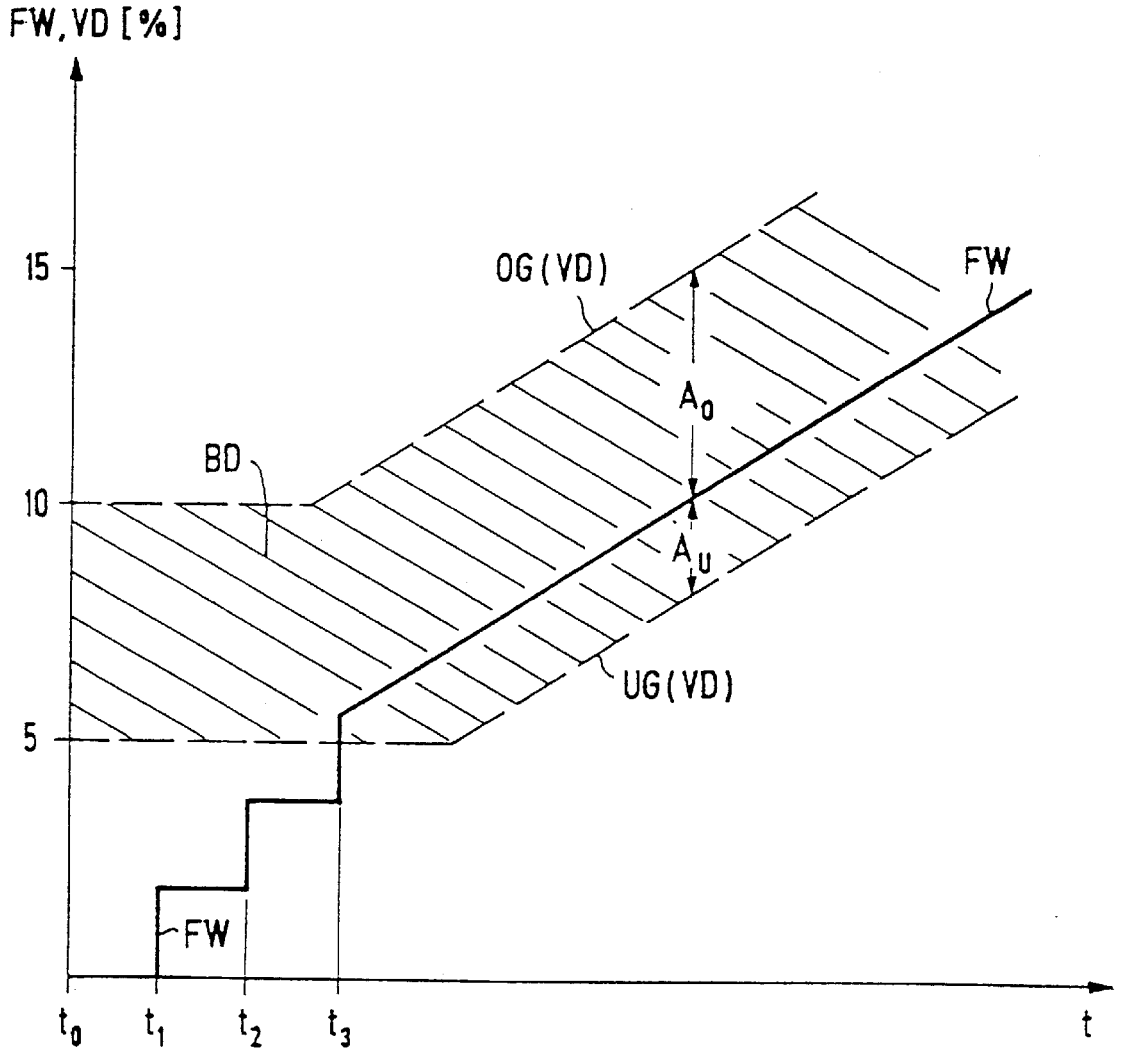
FIG. 2 is a graph illustrating start-up operation for evaporator throughput and firing heat capacity.

The evaporator throughput is set by the control device 58 in dependence on the fuel quantity supplied to the burner(s) 5 per unit time during start-up. For this purpose, the current value, measured by means of the flow sensor 40, of the quantity of feedwater S supplied to the evaporator, i.e., to the evaporator tubes 4, per unit time is supplied to the control module 54 via the signal line 50. This value supplied to the control module 54 by the flow sensor 42 corresponds to the current evaporator throughput VD (FIG. 2). Moreover, the current value of the firing heat capacity FW (FIG. 2) in the combustion chamber 6 is supplied to the control module 54 via the signal line 52. For this purpose, the quantity of fuel B supplied to the burners 5 via the fuel line 44 at the current time is determined by means of the flow sensor 42. This fuel throughput is converted by means of the transducer 53 into the corresponding firing heat capacity FW. From a comparison of the current firing heat capacity FW and of the current evaporator throughput VD, the control module 54 determines a regulating variable SG which controls the valve 38 or the rotational speed of the feed-water pump 34 via the line 56 or 56' respectively. At the same time, the quantity of feedwater S carried via the feed-water conduit 17 and therefore the evaporator throughput VD are set in proportion to the firing heat capacity FW in the combustion chamber 6. The evaporator throughput VD serves as a control variable. The time-dependent trend of the evaporator throughput VD and of the firing heat capacity FW is represented in FIG. 2.

The abscissa in FIG. 2 represents the time axis. Percentage figures are plotted on the ordinate and are related to the maximum evaporator throughput (evaporator throughput under 100% load) and to the maximum firing heat capacity (firing heat capacity under 100% load).

At the time t0, i.e., prior to the ignition of a first burner 5, a minimum throughput of less than 15% of the throughput under 100% load (full-load throughput) is already preferably set. In the exemplary embodiment, this minimum throughput is within a bandwidth BD of 5% to 10% of the throughput under 100% load, i.e., of the maximum evaporator throughput VD. This minimum throughput of 5% to 10% of the maximum evaporator throughput VD is set at the beginning of the start-up operation.

During the operation, the first burner 5 is ignited at a time t1, the firing heat capacity FW first rising abruptly. As a result of the ignition of a second burner 5 at the time t2 and of a third burner 5 at the time t3 the firing heat capacity FW initially rises in steps. From a firing heat capacity FW of about 6% of the maximum firing heat capacity, the firing heat capacity FW rises continuously over the time t. With the continuous rise of the firing heat capacity FW, the evaporator throughput VD is also increased continuously. At the same time, the evaporator throughput VD is preferably set in such a way that the percentage evaporator throughput VD related to the throughput under full load, within the bandwidth BD of 5% to 10% of the throughput under full load, is equal to the percentage firing heat capacity FW related to full load, i.e., to 100% load. The bandwidth BD, within which the evaporator throughput VD rises with the firing heat capacity FW over time, is limited upwards by an upper limit line or threshold OG and downwards by a lower limit line or threshold UG.

The evaporator throughput VD is advantageously set to rise uniformly with the firing heat capacity FW in time during the start-up operation. In this case, as is evident from FIG. 2, the bandwidth BD is asymmetric, a deviation of the percentage evaporator throughput VD from the percentage firing heat capacity upwards by 3% to 8% and downwards by 2% to 3% of the throughput under 100% load being permissible. In the exemplary embodiment, the bandwidth BD amounts to 5%, so that a deviation $A_o$ from the firing heat capacity FW upwards by 3% and a deviation $A_u$ from the firing heat capacity FW downwards by 2% are permissible.

By means of the control device 58, therefore, the quantity of feedwater S supplied to the evaporator 4 per unit time is set in such a way that the evaporator throughput deviates from the percentage firing heat capacity FW only in a narrow bandwidth of preferably 5% to 10%. Even in the case of a minimum throughput of less than 15%, that is to say even in the case of a limitation of the evaporator throughput VD at the commencement of the start-up operation to preferably 5% to 10% of the throughput under full load, uniform upward flow in all the evaporator tubes 4 is guaranteed. Start-up losses are kept particularly low as a result of such a start-up behavior, since, even under low load, the continuous-flow mode beneficial in terms of efficiency is achieved. Circulating pumps or run-off heat exchangers conventionally used in the prior art can be dispensed with in this starting method. In the water/steam separating vessel 20 illustrated in FIG. 1, separated water can be returned directly, without additional pumps, via a return conduit 62, into which a valve 63 is connected, into the feed-water tank 18 and therefore into the water/steam circuit. Since a return of the feedwater S from the water/steam separating vessel 20 upstream of the evaporator 4 or upstream of the economizer 15 and therefore downstream of the feed-water tank 18 in the direction of flow of the feedwater S can therefore also be dispensed with, a particularly simple control of the start-up operation is achieved.

We claim:

1. A method for starting up a continuous-flow steam generator of the type having a combustion chamber and a number of burners for combusting fossil fuel in the combustion chamber, the combustion chamber having a gas-tight containing wall formed of substantially vertical evaporator tubes, the method which comprises:

conducting a medium through the evaporator tubes from the bottom upwards;

supplying fuel to the burners and adjusting a firing heat capacity in the combustion chamber;

adjusting an evaporator throughput in dependence on a quantity of fuel supplied to one burner or each of the burners per unit time, defining a full-load evaporator throughput at 100%, and setting a minimum evaporator throughput at a beginning of a start-up operation to less than 15% of the full-load evaporator throughput.

2. The method according to claim 1, which comprises setting the minimum evaporator throughput at the beginning of the start-up operation to less than 10% of the full-load evaporator throughput.

3. The method according to claim 1, which comprises raising the evaporator throughput uniformly in time with the firing heat capacity.

4. The method according to claim 1, which comprises setting the evaporator throughput such that the evaporator throughput relative to the full-load evaporator throughput corresponds, within a given bandwidth, to a percentage firing heat capacity related to full load heat capacity.

5. The method according to claim 4, which comprises defining the given bandwidth asymmetrically, so as to permit an upward deviation of the percentage evaporator throughput from the percentage firing heat capacity by 3% to 8% and a downward deviation by 2% to 3% of the full-load throughput.

6. In a continuous-flow steam generator having a combustion chamber with a number of burners for fossil fuel, the combustion chamber having a gas-tight containing wall formed of substantially vertical evaporator tubes, a feedwater conduit leading into the evaporator tubes and a fuel line supplying the fossil fuel to the burners, an apparatus for starting up the continuous-flow steam generator, comprising:

a control module establishing a regulating variable determining an evaporator throughput, the evaporator throughput being proportional to a firing heat capacity established from the quantity of fuel fed to one of the burners or to each burner per unit time;

a regulating element connected to said control module, said regulating element being connected into the feedwater conduit leading to the evaporator; and a flow sensor connected to said control module, said flow sensor being disposed in the fuel line leading to the one burner or to each of the burners.

7. The apparatus according to claim 6, which comprises a further flow sensor disposed in the feedwater conduit, said further flow sensor being connected to said control module.

* * * * *